US006085572A

United States Patent [19]

McGuire, Sr. et al.

[11] Patent Number: 6,085,572

[45] Date of Patent: Jul. 11, 2000

[54] TUBE BENDING MANDREL

[75] Inventors: Samuel B. McGuire, Sr., Fountain; Jeffrey A. Siebert, Manitou Springs, both of Colo.

[73] Assignee: Tube Bending Cocepts, Inc., Fountain, Colo.

[21] Appl. No.: 09/181,521

[22] Filed: Oct. 28, 1998

[51] Int. Cl.[7] ..... B21D 9/03

[52] U.S. Cl. ..... 72/466.2

[58] Field of Search ..... 72/466, 466.2

[56] References Cited

U.S. PATENT DOCUMENTS

| | | | |
|---|---|---|---|
| 1,683,573 | 9/1928 | Mueller et al. . | |
| 1,978,452 | 10/1934 | Flodin | 29/157 |
| 2,776,697 | 1/1957 | Zerlaut | 153/63 |
| 2,916,077 | 12/1959 | Fuchs, Jr. | 153/63 |
| 3,118,488 | 1/1964 | Barnhill | 153/40 |
| 3,190,106 | 6/1965 | Spates | 72/466 |
| 3,286,503 | 11/1966 | Garrett | 72/466 |
| 3,315,516 | 4/1967 | Sassak | 72/466 |
| 3,408,850 | 11/1968 | Maier et al. | 72/466 |
| 3,415,107 | 12/1968 | Ruscitti | 72/466 |
| 3,455,142 | 7/1969 | Roberts | 72/466 |
| 3,456,482 | 7/1969 | Maier et al. | 72/465 |
| 3,750,455 | 8/1973 | Stange et al. | 72/466 |
| 4,315,423 | 2/1982 | McGuire | 72/466 |
| 4,475,375 | 10/1984 | Hill | 72/466 |
| 4,493,203 | 1/1985 | Wheeler et al. | 72/369 |
| 4,635,464 | 1/1987 | McGuire, Sr. et al. | 72/466 |

FOREIGN PATENT DOCUMENTS 2229492 9/1990 United Kingdom .

*Primary Examiner*—Lowell A. Larson
*Attorney, Agent, or Firm*—Linda Flewellen Gould

[57] ABSTRACT

A tube bending mandrel is provided, which is designed to avoid stress, fracture, and disassembly caused by forces exerted while a tube is bent. The mandrel includes mandrel links with a ball end, neck, and socket end, formed from two opposing and matching link sections. A radial tenon protruding from the face of one link section fits into a corresponding radial mortise formed in the face of the opposing link section. A detent mechanism includes a ball slot formed in the exterior of a ball end, a circular spring that fits into that ball slot, and a socket groove formed in the interior of an adjacent socket in which the ball end fits and rotates. By providing a ramp on one edge of the socket groove or the ball slot, the circular spring tends to move into the socket groove and ball slot, to assume a straight position after the mandrel has been removed from a bent tube. An external shoulder is provided on each socket, adjacent to the socket opening, to support a ball segment.

8 Claims, 8 Drawing Sheets

TUBE BENDING MANDREL

BACKGROUND OF THE INVENTION

1. Technical Field

This invention pertains to a specialized tube bending mandrel having ease of assembly and durability.

2. Background Art

Tube bending mandrels are typically used to support the inside of a tube as it is being bent. The mandrel is inserted into the section of a tube that is to be bent. As pressure is applied to the tube to bend it into a desired shape, the flexible mandrel bends with the tube but supports the inside of the tube to prevent collapse or undue distortion. After the tube is bent to the desired shape, the mandrel is removed from inside the tube. Specific tube bending practices are taught in U.S. Pat. No. 3,118,488 to Barnhill and U.S. Pat. No. 3,456,482 to Maier et al.

Commonly used mandrels are constructed of articulated links connected in a flexible line. Each link typically includes a ball end and a socket end, with each socket end being shaped to fit snugly over the ball end of an adjacent link. (Alternative designs are revealed in U.S. Pat. No. 1,683,573 to Mueller et al. and U.S. Pat. No. 4,493,203 to Wheeler et al., utilizing mandrel designs without ball and socket links.) When the mandrel is inserted into a tube, the interior of the tube contacts the outer surface of ball segments surrounding these articulated links. Pressure is applied to bend the tube to a desired shape. As pressure is applied to bend the tube, the ball of each link rotates within the socket of the adjacent link, allowing the mandrel to move with the tube, while providing interior support to the tube to avoid the tube being crushed. See e.g., U.S. Pat. No. 1,978,452 to Flodin, U.S. Pat. No. 3,415,107 to Ruscitti, and U.S. Pat. No. 3,456,482 to Maier et al.

Each mandrel link may be constructed as a single unit ball and socket, as shown in U.S. Pat. No. 3,455,142 to Roberts and UK Patent 2 229 492. Other mandrel designs utilize a link constructed in multiple sections, to provide more flexibility within the mandrel link as well as to simplify the process of assembling the mandrel. Examples of mandrel links composed of multiple sections, with each connecting face perpendicular to the longitudinal axis of the mandrel, include U.S. Pat. No. 2,776,697 to Zerlaut and U.S. Pat. No. 3,408,850 to Maier et al. Similarly, U.S. Pat. No. 2,916,077 to Fuchs, Jr., U.S. Pat. No. 3,315,516 to Sassak, U.S. Pat. No. 4,635,464 to McGuire, Sr. et al, and U.S. Pat. No. 3,190,106 to Spates describe mandrel links comprised of two longitudinally facing halves.

Use of longitudinally arrayed link sections facilitates assembly and disassembly. However, if the mechanism for connecting the two link halves does not result in an exact placement of the two halves vis a vis each other, problems result. As the tube is bent the mandrel is subjected to large forces. These forces are exerted on the device in different directions. Thus, the two link halves are likely to be subjected to forces which result in longitudinal displacement, as one half of the link is subjected to larger forces than the other. Not only is this situation detrimental to supporting the interior of the tube as it is bent, the mandrel itself is subjected to rapid wear and eventual failure. The narrow neck portion of a link between the ball and socket ends is particularly susceptible to such forces, possibly resulting in a break at that neck.

It is desirable that the mandrel be prone to resuming its original shape, by some method of detent, so that the same mandrel may be inserted in additional straight tubes to facilitate bending. Particular detent mechanisms known in the prior art are taught in U.S. Pat. No. 3,286,503 to Garrett, U.S. Pat. No. 3,750,455 to Stange et al., U.S. Pat. No. 4,475,375 to Hill, and U.S. Pat. No. 4,315,423 to McGuire. As the mandrel is repeatedly used, known detent mechanisms tend to wear out as a spring used in the mechanism is stretched away from its original neutral position. Eventually, such detent mechanisms may become ineffective, so that the mandrel does not resume its original shape.

While each of the mandrel designs taught in the prior art is useful for its intended purpose, the repetitive forces applied during the process of bending a tube tend to cause wear in the mandrel link and decrease the effectiveness of the detent mechanism. Bending forces can play havoc with mandrels in other ways as well. For ease of assembly and disassembly, mandrel links are frequently constructed of two facing components. As a tube surrounding a mandrel is bent, the forces bending the tube may also result in the mandrel link components being pushed away from each other. A mandrel design is needed which will have a significantly longer useful life, despite the impact of such forces.

DISCLOSURE OF THE INVENTION

Summary of the Invention

An object of this invention is to provide a tube-bending mandrel which is resistant to fracture, displacement of parts thereof, and exhaustion despite the constant forces applied to the mandrel during a tube-bending process.

Another object of this invention is to provide a tube-bending mandrel which is easy to assemble and disassemble, including ease of effectuating a detent mechanism.

Yet another object of this invention is to provide such a tube-bending mandrel which will bend in any direction, and is not limited to a single plane of motion.

In tube bending operations, it is useful to place a mandrel within the tube to be bent, to provide support to that tube and prevent the tube from being crushed or broken. A typical mandrel comprises a series of links, each link having a ball end and a socket end, so that the ball end of one link may fit into and move within the socket end of an adjacent link. Each socket end supports a ball segment which surrounds and contacts the socket end. A typical ball segment is circular, with the interior contacting the socket end of a mandrel link, while the exterior of the ball segment contacts and supports the inside of a tube being bent.

For ease of assembly and disassembly, each mandrel link of the mandrel design claimed herein is composed of two link sections with opposing faces. Thus, each link section comprises one-half of the ball end and one half of the socket end of a mandrel link, when two facing sections are aligned along a plane that extends longitudinally from the ball end to the socket end.

Each pair of link sections is connected by a radial mortise and tenon joint. A radial tenon protrudes from the face of one link section, while a corresponding radial mortise is formed in the face of the opposing link section, so that the tenon can be rotated into the mortise as the two links are fit together. Because of the tapered design of the mortise and tenon, forces exerted on the mandrel link during a tube bending operation tend to push the two link sections together, rather than driving them apart as can happen with currently used mandrel links. The bending forces are therefore channeled in a constructive direction, rather than causing stress and possibly failure of the mandrel link.

As a mandrel is flexed inside a tube being supported by the mandrel, each ball end rotates within the socket end of the adjacent mandrel link. In a conventional mandrel link, this results in significant force on the neck between ball end and socket end, which can lead to a fracture of the link at the neck. The neck is necessarily narrow to provide freedom of motion in all directions as the tube is bent. The radial mortise and tenon design significantly decreases the forces applied to the weak neck of the mandrel link. As each link is rotated, the radial dove tail angle of the mortise and tenon joint drives the two link sections together, providing additional stability to the mandrel link. Both link sections are stressed equally, providing maximum possible strength for the mandrel link.

Typically, the tenon and corresponding mortise will form an angle of not less than seven degrees with respect to a tangent taken from a point on the tenon. A smaller angle might cause binding when stressed. A tenon with an angle of thirteen to seventeen degrees with respect to such a tangent has been found to be particularly useful, both in terms of ease of use and channelling bending forces in a manner that results in a stronger mandrel link.

Just as the forces exerted to bend a tube tend to stress and potentially fracture a mandrel link, those forces can exhaust a detent mechanism designed to return the mandrel link to a straight position after a bending operation is completed. A relatively long-lasting detent mechanism is achieved as follows. A ball slot is formed around the exterior of a ball end, suitable for receiving a circular spring. A radial spring is inserted in that ball slot, with a small portion of that radial spring protruding outward from the ball end. The socket end of an adjacent mandrel link in which the ball end rotates is provided with an internal groove, suitable for receiving the protruding portion of the radial spring. Thus, the spring surrounding the ball slot tends to move into the internal socket groove, moving the mandrel links into a straight end-to-end formation, after a bending operation is completed and the mandrel is removed from the bent tube. To facilitate the radial spring moving into a position which straightens the mandrel, a ramp is provided along the socket groove, which ramp encourages the spring to move into the socket groove. The ramp both assists in moving the circular spring into a desired position, and relieves stress on that spring when the mandrel is bent within a tube. As a result, this detent mechanism does not wear out as quickly as conventional detent elements. It has proven particularly advantageous to construct the ramp on the side of the internal socket groove closest to the opening of the socket end of each mandrel link.

The mandrel link claimed herein is further strengthened against the detrimental effect of bending forces by placement of an external shoulder suitable for supporting a ball segment on the socket end of each mandrel link, in a position designed to provide maximum support to the mandrel link. By placing the external shoulder on the socket end, adjacent to the opening of the socket, the ball segment surrounding and engaging that shoulder tends to force the two link sections together, adding further strength to the mandrel link.

The novel features that are considered characteristic of the invention are set forth with particularity in the claims. The invention itself, both as to its construction and its method of operation, together with additional objects and advantages thereof, will best be understood from the description of specific embodiments which follows, when read in conjunction with the accompanying drawings.

DETAILED DESCRIPTION OF THE PREFERRED EMBODIMENT

The present invention concerns a new and improved tube bending mandrel. A mandrel is used to support the inside of a tube during a bending operation, to prevent the tube from being crushed or broken as the tube is bent to a desired shape.

In the following description, numerous specific details are set forth, in order to provide a thorough understanding of the present invention. It will be obvious, however, to one skilled in the art that the present invention may be practiced without these specific details. Some well-known methods and structure have not been set forth in order not to unnecessarily obscure the description of the present invention.

Figure 1:
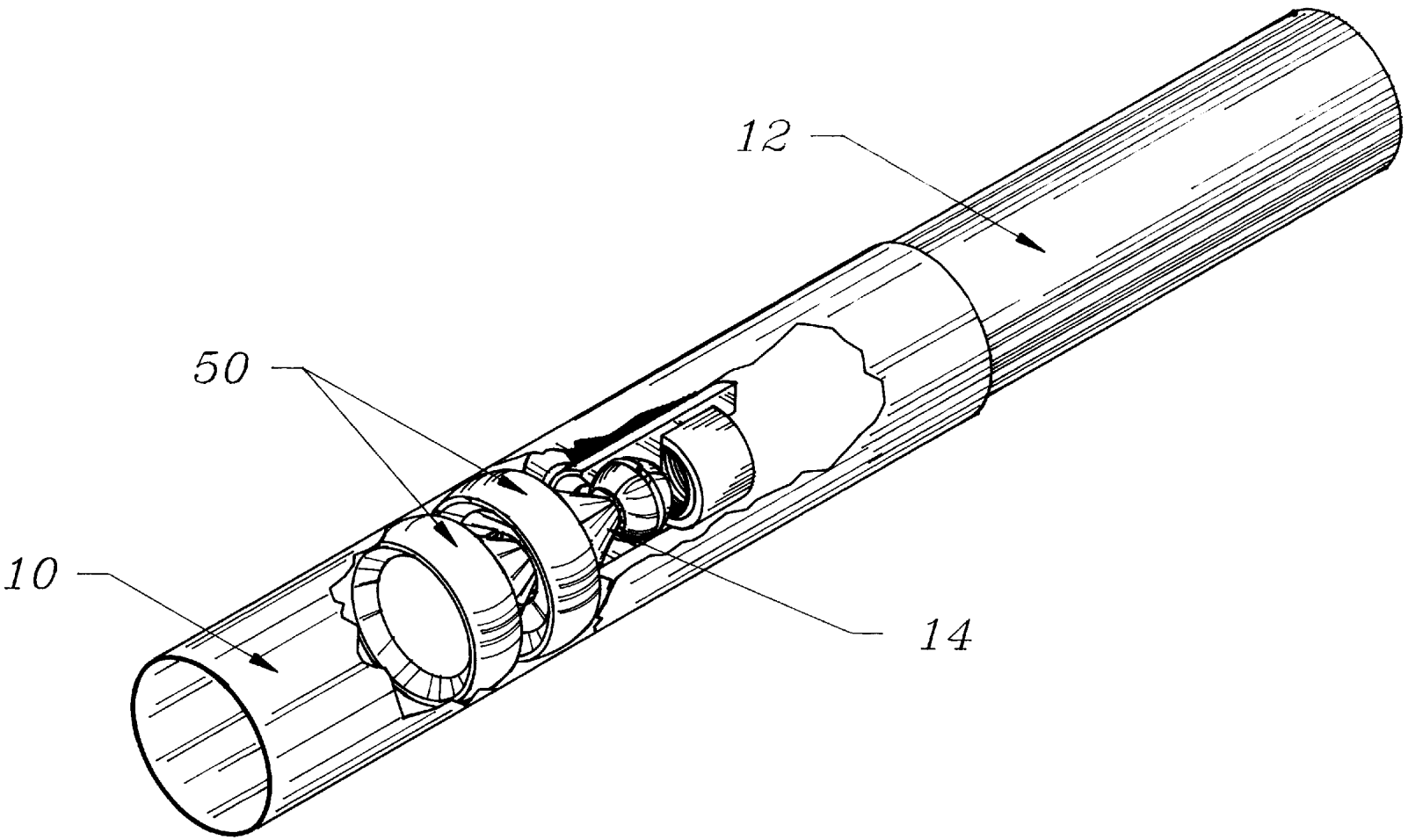
FIG. 1 is a cut-away side view of a mandrel inserted into a tube to be bent, according to the present invention.
Figure 2:
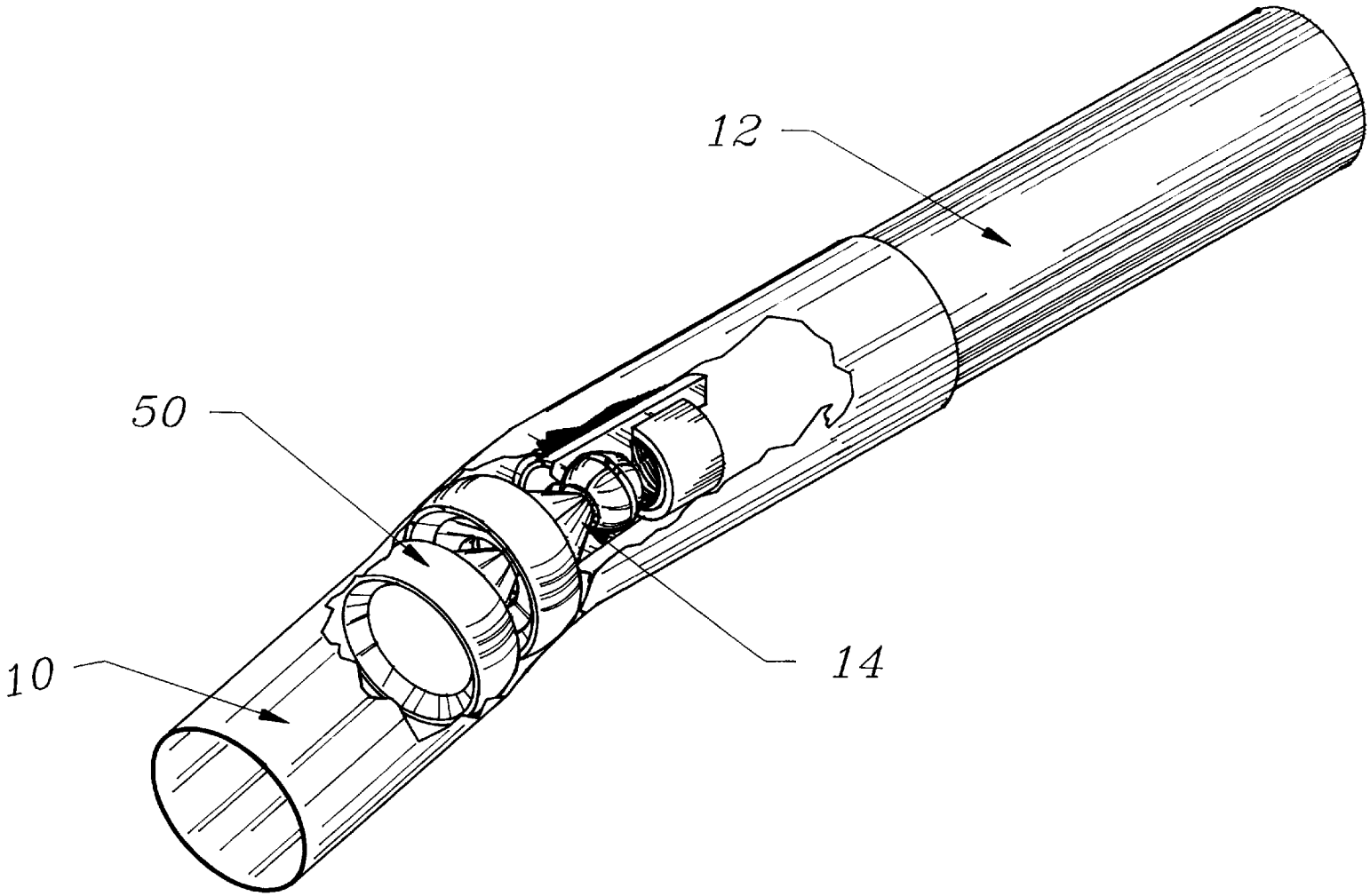
FIG. 2 is a cut-away side view of a mandrel supporting a tube in a tube-bending operation, according to the present invention.
Figure 3:
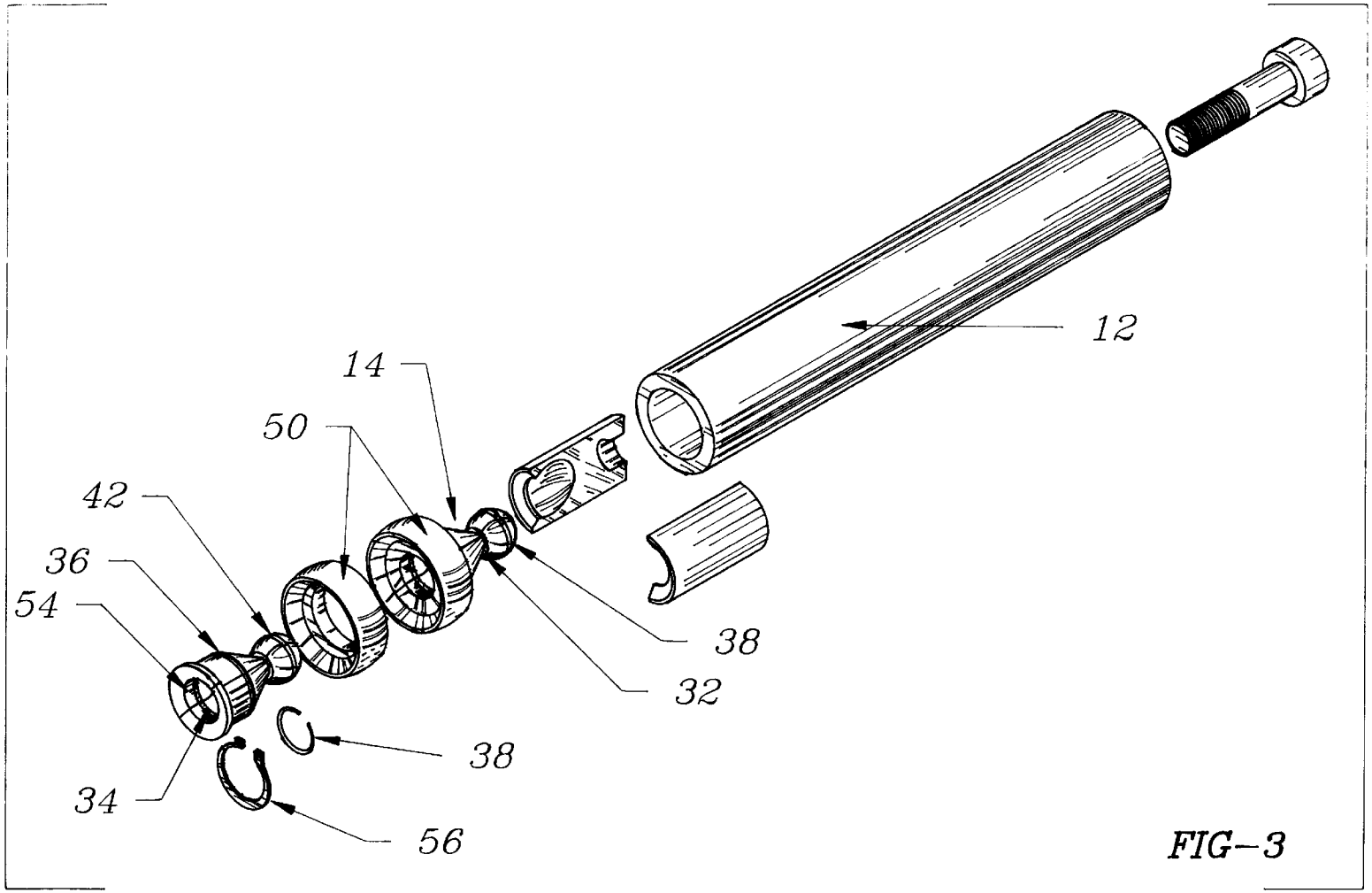
FIG. 3 is a perspective exploded view of a tube bending mandrel, according to the present invention.

The tube bending mandrel of the present invention can be better understood by reference to FIG. 1. A mandrel 12 is inserted into a straight tube 10 to support that tube 10 as shown in FIG. 1. As the tube 10 is bent to a desired position, as shown in FIG. 2, the mandrel 12 prevents the tube 10 from being crushed or broken. The mandrel 12 includes multiple ball segments 50, each of which is circular to fit within and support the interior of the tube 10. Each ball segment fits onto and is supported by a mandrel link 14, as shown in FIG. 3.

Figure 4:
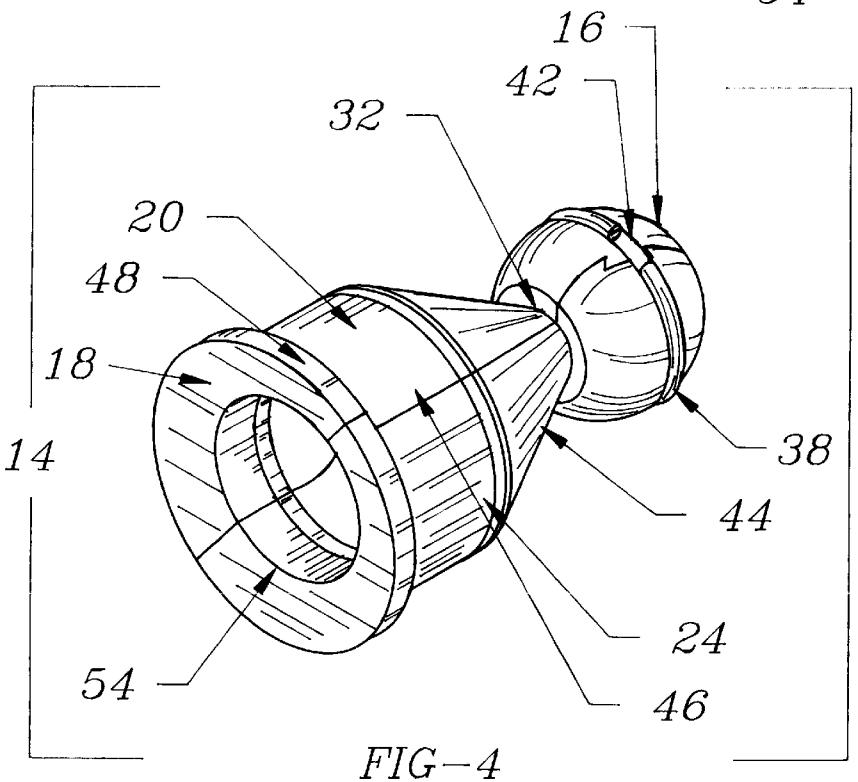
FIG. 4 is a perspective view of a mandrel link, according to the present invention.

Each mandrel link 14 comprises a ball end 16, a socket end 18, and a neck 32 between said ball 16 and socket 18, as shown in FIG. 4. Thus, each ball end 16 can be inserted into a socket end 18 of an adjacent mandrel link 14, allowing each ball end 16 to be rotated within said socket end 18, as demonstrated in FIG. 2. As the tube 10 is bent, each ball end 16 can move within the adjacent socket end 18, in whatever direction is advantageous, so that the mandrel 12 effectively bends with the tube 10. However, forces applied to bend the tube 10 can stress the mandrel 12, and are particularly injurious to the narrow neck 32 of each link 14.

Figure 5:
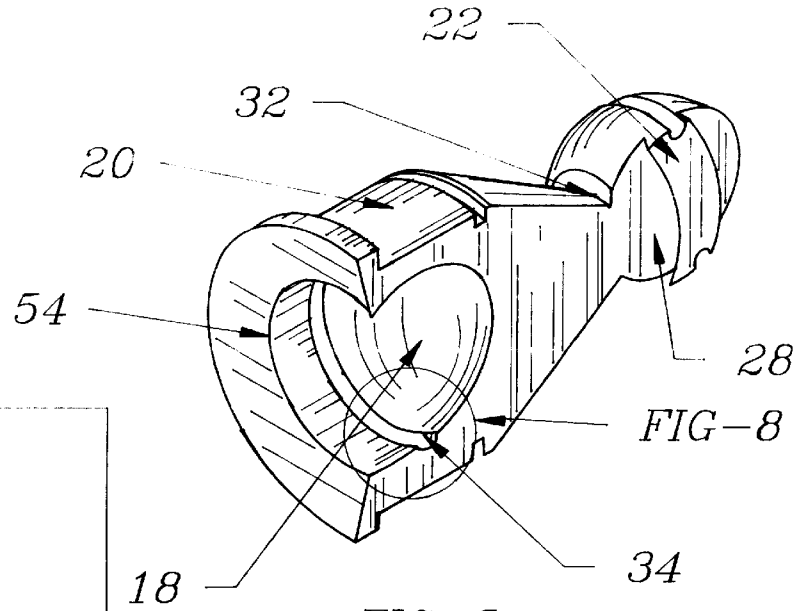
FIG. 5 is a perspective view of a tenon section of a mandrel link, according to the present invention.
Figure 6:
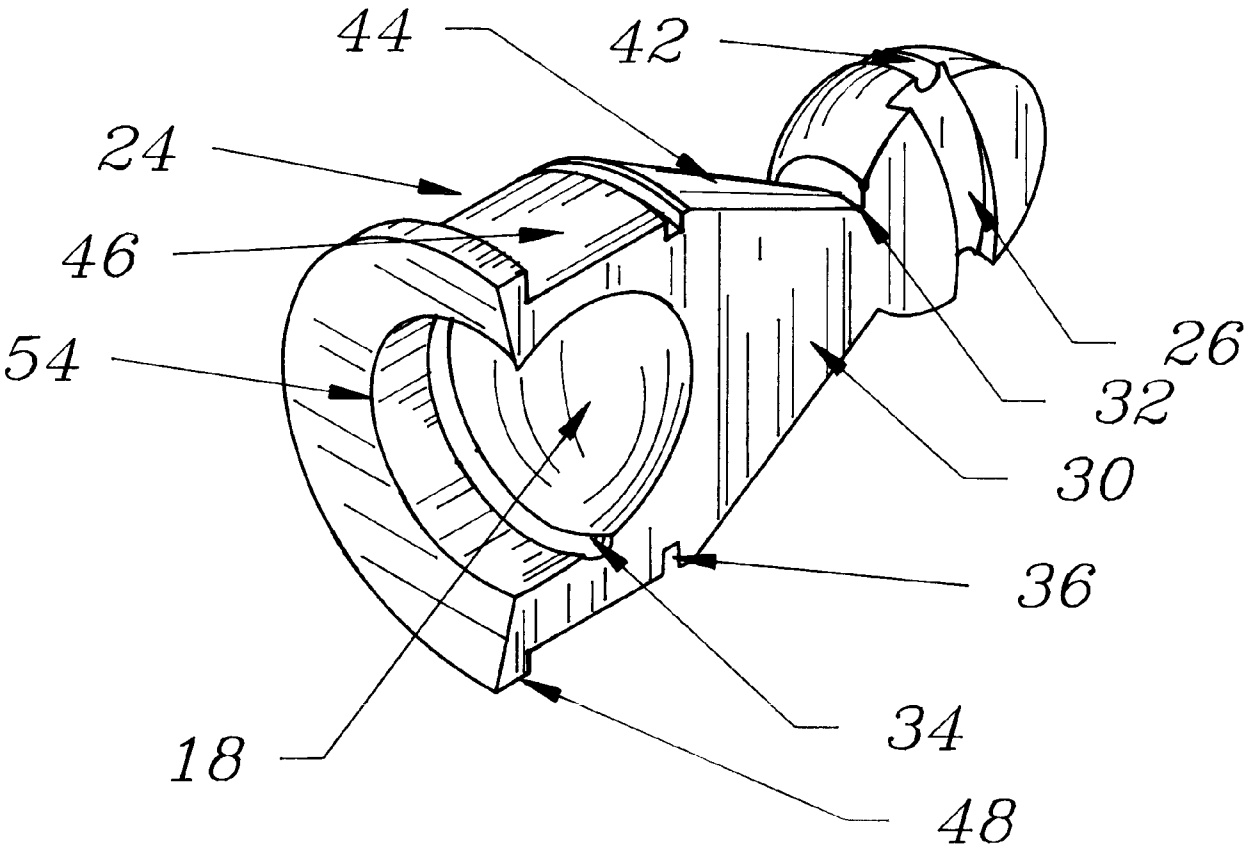
FIG. 6 is a perspective view of a mortise section of a mandrel link, according to the present invention.
Figure 7:
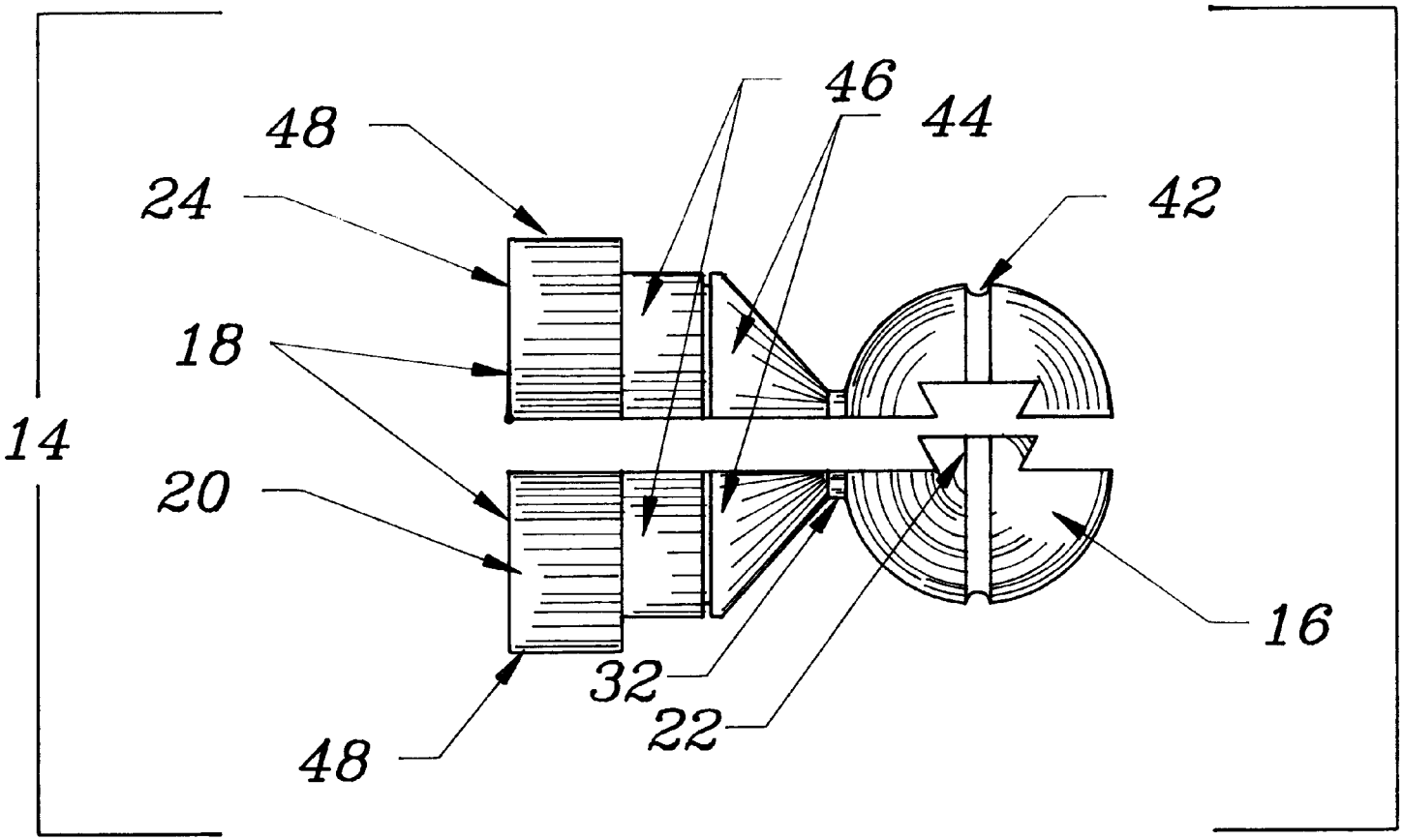
FIG. 7 is a side view of a mortise section and corresponding tenon section of a mandrel link, according to the present invention.

To facilitate easy assembly and disassembly of the mandrel 12, each mandrel link 14 is advantageously formed from two opposing link sections 20,24, as shown in FIG. 7. A radial tenon 22 protrudes from the face 28 of one link section 20, as shown in FIG. 5, while a corresponding radial mortise 26 is formed in the face 30 of the opposing link section 24, as best seen in FIG. 6. Ideally, the radial mortise 26 is exactly the size and shape to tightly receive the radial tenon 22 when the opposing faces 28,30 of the link sections 20,24 are adjacent to each other. To assemble a mandrel link 14, the tenon 22 is rotated into the mortise 26, until the link sections 20, 24 are aligned in face-to-face abutment along a plane that extends longitudinally from the ball end 16 to the socket end 18, as shown in FIG. 4.

It has proven advantageous to form each tenon 22 and mortise 26 with an angle of not less than seven degrees from a tangent to the tenon 22. If an angle of less than seven degrees was used, there would be considerable frictional resistance between the tenon 22 and mortise 26, possibly restricting their movement toward one another and hindering the formation of a matched mandrel link 14. When the mortise 26 and tenon 22 are formed with an angle of seven or greater degrees with respect to a tangent to the tenon 22, forces exerted during a bending operation tend to push the two link sections 20,24 together. In this manner, the forces applied to bend a tube 10 tend to drive the link sections 20,24 together, providing strength for each mandrel link 14. This alleviates stress which might otherwise fatigue and possibly fracture the narrow neck 32 of the mandrel link 14.

A novel detent mechanism is also provided, to lessen the detrimental effect of tube bending forces on the mandrel 12. Since the mandrel 12 is designed to be used repeatedly, it is advantageous for the mandrel 12 to assume a straight position when it is removed from a tube 10 which has been bent. Once the mandrel 12 is in a straight position, it can be inserted into a new straight tube 10 to support that tube 10 as it is bent. A detent mechanism propels the mandrel 12 into a straight position, but typically becomes less effective through repeated use, as a result of the forces exerted on that mechanism during a tube bending operation.

Figure 8:
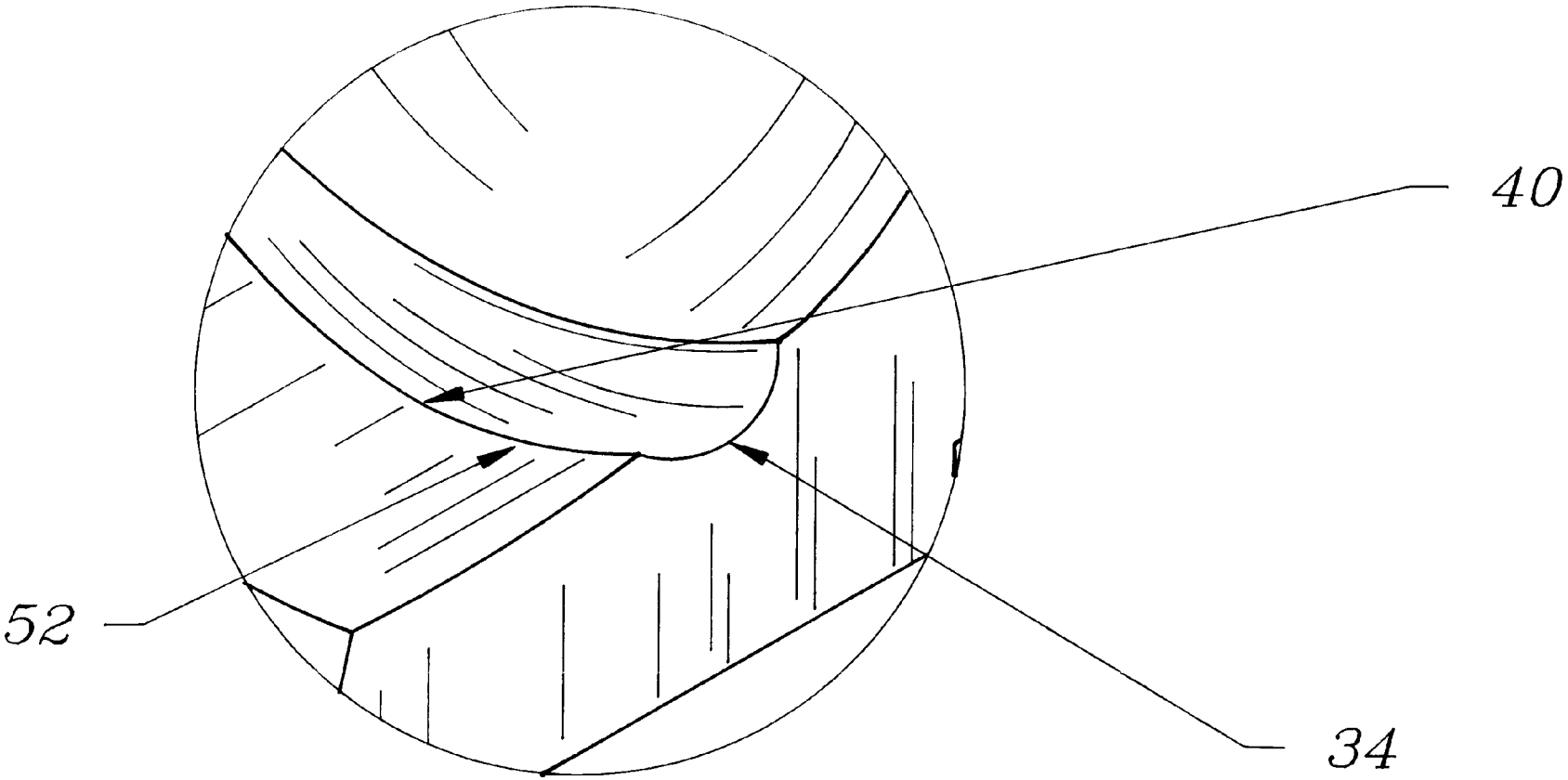
FIG. 8 is a magnified view of a portion of the tenon section shown in FIG. 5, according to the present invention.
Figure 9:
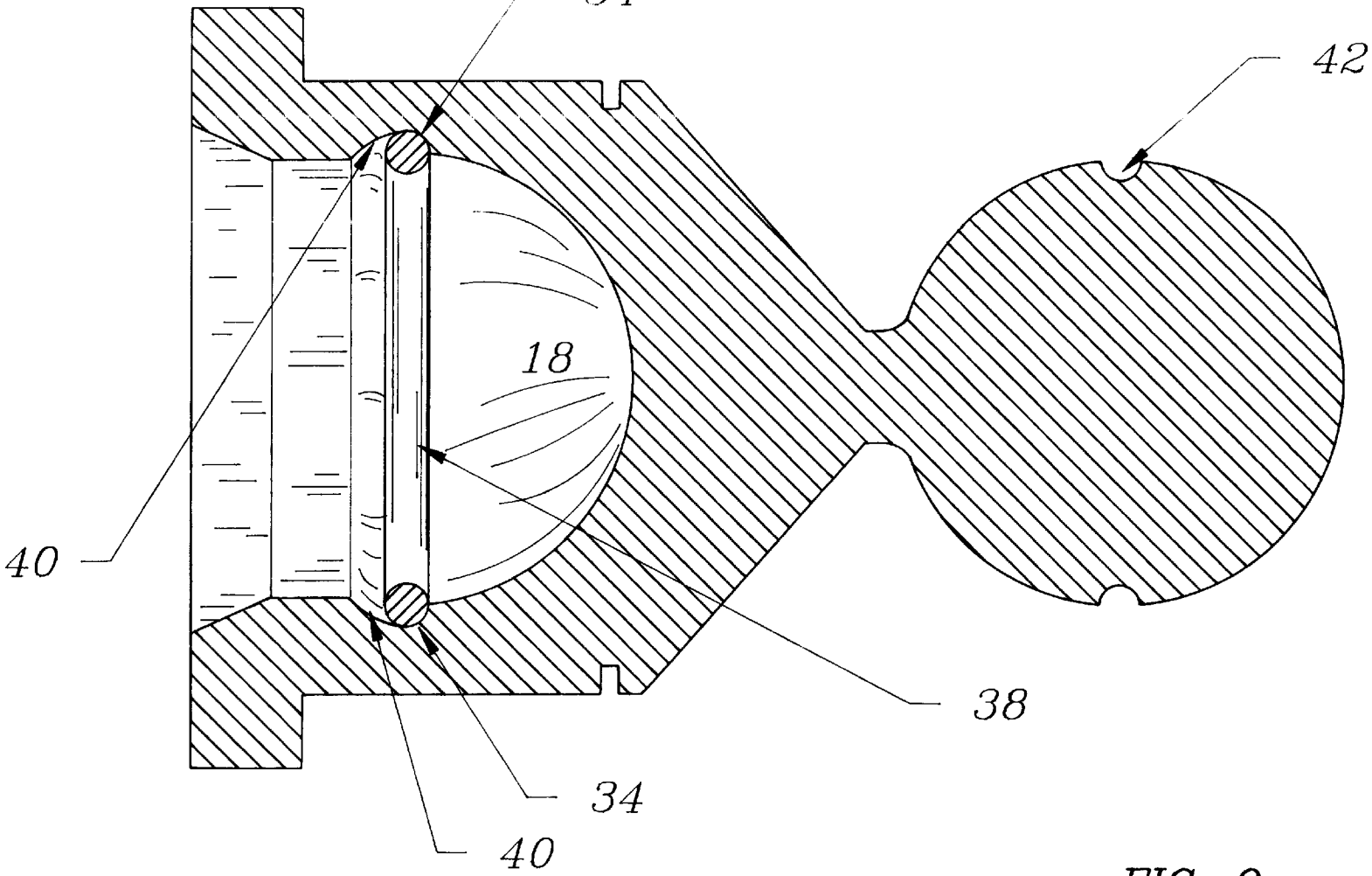
FIG. 9 is a cross-sectional view of a mandrel link according to the present invention.

The novel detent mechanism claimed herein includes a radial spring 38 which fits into a ball slot 42 external to the ball end 16, and a socket groove 34 internal to the socket end 18, as best shown in FIG. 4. To facilitate movement of the spring 38 from the ball slot 42 into the socket groove 34, a ramp 40 is provided on one edge of the socket groove 34 to lead the spring 38 into the socket groove 34. This aligns the socket groove 34 with the ball slot 42. As shown in FIGS. 8 and 9, it has proven useful to form a ramp 40 on the edge 52 of the socket groove 34 which is closest to the opening 54 of the socket end 18. When the mandrel 14 has been flexed inside a tube 10, and is then removed from the tube 10, the ramp 40 supports the circular spring 38 and drives it into the socket groove 34, forcing the mandrel link 14 into a straight position with respect to adjacent links 14.

To provide further strength for the novel mandrel link 14 claimed herein, each socket end 18 can advantageously be provided with an external shoulder 48, suitable for supporting a ball segment 50, in a position designed to drive adjacent link sections 20,24 toward each other. As shown in FIG. 4, the exterior of each socket end 18 may include a tapered area 44 extending from the neck 32, away from the ball end 16. This tapered area 44 is followed by a straight area 46. An external groove 36 can be conveniently formed in the straight area 46 to receive a snap ring 56 which holds the surrounding ball segment 50 in place, as shown in FIG. 3. The external shoulder 48 protrudes from the straight area 46 adjacent to the socket opening 54. Ideally, the shoulder 48 has an external diameter that is only slightly smaller than the internal diameter of the ball segment 50, so that the ball segment 50 fits tightly around the shoulder 48, providing maximum support for the socket 18. In this manner, the ball segment 50 is held in place by and provides pressure to the shoulder 48 in the area best suited to driving the two link sections 20,24 together, and to support the open end 54 of the socket end 18.

The invention has been described in detail with particular reference to preferred embodiments thereof. As will be apparent to those skilled in the art in the light of the accompanying disclosure, many alterations, substitutions, modifications, and variations are possible in the practice of the invention without departing from the spirit and scope of the invention.

| ELEMENTS OF INVENTION | |
|---|---|
| 10 | tube to be bent |
| 12 | mandrel |
| 14 | mandrel link |
| 16 | ball end |
| 18 | socket end of link |
| 20 | tenon section of link |
| 22 | protruding radial tenon |
| 24 | mortise section of link |
| 26 | radial mortise |
| 28 | face of tenon section |
| 30 | face of mortise section |
| 32 | neck of link |
| 34 | internal socket groove |
| 36 | external socket groove |
| 38 | radial spring |
| 40 | ramp to internal socket groove |
| 42 | external ball slot |
| 44 | tapered external socket area |
| 46 | straight external socket area |
| 48 | external shoulder of socket |
| 50 | ball segment |
| 52 | edge of socket groove |
| 54 | opening of socket end |
| 56 | snap ring in external socket groove |

I claim:

1. A tube-bending mandrel comprising:

a. a plurality of links, each link having a ball end and a socket end, b. the ball end of one of said links being positioned within the socket end of an adjacent one of said links, c. each said link being formed of first and second mating link sections, each said section having a face so that said first and second mating link sections are positioned in face-to-face abutment with each other along a plane that extends longitudinally from the ball end to the socket end, d. each said first mating link section having a curved radial tenon protruding from the face thereof, e. each said second mating link section having a curved radial mortise formed in the face thereof, suitable for receiving said radial tenon.

2. A tube-bending mandrel according to claim 1, further comprising:

f. at least one ball segment having an exterior and interior, said ball segment exterior being suitable for contacting and supporting a tube to be bent when said ball segment is inserted into the tube, g. at least one socket end having an exterior shoulder suitable for contacting and fitting against said ball segment interior, h. said shoulder being positioned adjacent to an open end of said socket end.

3. A tube-bending mandrel according to claim 2, further comprising:

i. a circular spring, j. at least one ball end having an exterior and an interior, said ball exterior having a circular ball slot formed therein surrounding said ball exterior suitable for receiving said circular spring, k. at least one socket end having an exterior and an interior, said socket interior having a circular socket groove formed therein suitable for receiving said circular spring, l. wherein said circular socket groove has at least one edge which is sloped to form a ramp.

4. A tube-bending mandrel comprising:

a. a plurality of links, each link having a ball end and a socket end, b. the ball end of one of said links being positioned within the socket end of an adjacent one of said links, c. each said link being formed of first and second mating link sections, each said section having a face so that said first and second mating link sections are positioned in face-to-face abutment with each other along a plane that extends longitudinally from the ball end to the socket end, d. each said first mating link section having a radial tenon protruding from the face thereof, e. each said second mating link section having a radial mortise formed in the face thereof, suitable for receiving said radial tenon, f. wherein said radial tenon forms an angle of greater than seven degrees with respect to a line which is tangential to said tenon.

5. A tube-bending mandrel comprising:

a. a plurality of links, each link having a ball end and a socket end, b. the ball end of one of said links being positioned within the socket end of an adjacent one of said links, c. a circular spring, d. at least one ball end having an exterior and an interior, said ball exterior having a circular ball slot formed therein surrounding said ball exterior suitable for receiving said circular spring, e. at least one socket end having an exterior and an interior, said socket interior having a circular socket groove formed therein suitable for receiving said circular spring, f. wherein said circular socket groove has at least one edge which is sloped to form a ramp.

6. A tube-bending mandrel according to claim 5, wherein:

a. said circular socket groove has a first edge and a second edge, b. said first edge being closer to an open end of said socket interior than said second edge, and c. said first edge is sloped to form said ramp.

7. A tube-bending mandrel comprising:

a. a plurality of links, each link having a ball end and a socket end, b. the ball end of one of said links being positioned within the socket end of an adjacent one of said links, c. each said link being formed of first and second mating link sections, each said section having a face so that said first and second mating link sections are positioned in face-to-face abutment with each other along a plane that extends longitudinally from the ball end to the socket end, d. each said first mating link section having a radial tenon protruding from the face thereof, e. each said second mating link section having a radial mortise formed in the face thereof, suitable for receiving said radial tenon, f. a circular spring, g. at least one ball end having an exterior and an interior, said ball exterior having a circular ball slot formed therein surrounding said ball exterior suitable for receiving said circular spring, h. at least one socket end having an exterior and an interior, said socket interior having a circular socket groove formed therein suitable for receiving said circular spring, i. wherein said circular socket groove has at least one edge which is sloped to form a ramp.

8. A tube-bending mandrel according to claim 7, wherein:

a. said circular socket groove has a first edge and a second edge, b. said first edge being closer to an open end of said socket interior than said second edge, and c. said first edge is sloped to form said ramp.

* * * * *